US010076759B1

(12) United States Patent
Christian

(10) Patent No.: US 10,076,759 B1
(45) Date of Patent: Sep. 18, 2018

(54) MODULAR SPRAY ASSEMBLY FOR A WORKING MACHINE

(71) Applicant: Roadtec, Inc., Chattanooga, TN (US)

(72) Inventor: Richard Christian, Chattanooga, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 15/924,983

(22) Filed: Mar. 19, 2018

Related U.S. Application Data

(60) Provisional application No. 62/489,752, filed on Apr. 25, 2017.

(51) Int. Cl.

| | |
|---|---|
| ***E01C 19/08*** | (2006.01) |
| ***B05B 1/30*** | (2006.01) |
| ***B05B 13/02*** | (2006.01) |
| ***E01C 19/17*** | (2006.01) |
| ***B05B 7/02*** | (2006.01) |
| ***E01C 23/06*** | (2006.01) |
| *E01C 19/10* | (2006.01) |

(52) U.S. Cl.
CPC ..... *B05B 1/3033* (2013.01); *B05B 7/02* (2013.01); *B05B 13/0278* (2013.01); *E01C 19/172* (2013.01); *E01C 23/065* (2013.01); *E01C 19/08* (2013.01); *E01C 19/1004* (2013.01); *E01C 2301/50* (2013.01)

(58) Field of Classification Search
CPC .... E01C 19/08; E01C 19/1004; E01C 19/172; E01C 23/065; E01C 2301/50; B05B 1/3033; B05B 7/02; B05B 13/0278
USPC ..... 404/101–105, 111, 118
See application file for complete search history.

(56) References Cited

U.S. PATENT DOCUMENTS

| | | | | |
|---|---|---|---|---|
| 2,256,639 A | | 9/1941 | Erickson | |
| 4,817,870 A | * | 4/1989 | Dalton | B05B 9/06 239/157 |
| 4,960,242 A | | 10/1990 | Larson | |
| 5,549,457 A | * | 8/1996 | Flores | E01C 19/176 404/111 |

(Continued)

OTHER PUBLICATIONS

International Search Report and Written Opinion of Counterpart PCT Application No. PCT/US2018/23104 filed Mar. 19, 2018.

*Primary Examiner* — Raymond W Addie
(74) *Attorney, Agent, or Firm* — Chambliss, Bahner & Stophel, P.C.

(57) ABSTRACT

A modular spray assembly for a working machine includes a base assembly that is attached to the frame of the working machine. The base assembly includes a working fluid conduit having an open end and a closed end, and a plurality of nozzle assemblies that are attached to and are in fluid communication with the working fluid conduit. A modular component includes a nozzle assembly, a first end, and a second end. The second end of the modular component is adapted to be removably attached to the open end of the working fluid conduit so as to be in fluid communication with the working fluid conduit. The modular spray assembly also includes an open end component that is adapted to be removably and alternatively attached to the open end of the working fluid conduit or to the first end of the modular component. The open end component includes a working fluid supply pipe that is in fluid communication with the working fluid storage tank of the working machine.

8 Claims, 10 Drawing Sheets

(56) References Cited

U.S. PATENT DOCUMENTS

| | | | | | |
|---|---|---|---|---|---|
| 5,851,085 | A * | 12/1998 | Campbell | E01C 19/174 | 404/75 |
| 5,895,173 | A * | 4/1999 | O'Brien | E01C 19/21 | 404/108 |
| 5,957,621 | A | 9/1999 | Clark, Jr. et al. | | |
| 7,438,764 | B1 | 10/2008 | Hill | | |
| 9,845,579 | B2 * | 12/2017 | Pembleton | E01C 7/00 | |
| 2014/0353394 | A1 | 12/2014 | Foster et al. | | |
| 2016/0215461 | A1 | 7/2016 | Hays | | |

* cited by examiner

MODULAR SPRAY ASSEMBLY FOR A WORKING MACHINE

CROSS-REFERENCE TO RELATED APPLICATION

This application claims the benefit of U.S. Provisional Patent Application No. 62/489,752 which was filed on Apr. 25, 2017.

FIELD OF THE INVENTION

This invention relates to a spray assembly for a working machine such as a milling machine, a reclaimer/soil stabilizer machine, a cold recycler machine, a tack distributor truck, or an asphalt paving machine. More specifically, the invention relates to a modular spray assembly that can be employed in various sizes to match the width of various working machines.

BACKGROUND AND DESCRIPTION OF THE PRIOR ART

Roadwork is typically carried out by working machines that carry one or more working components and travel along a roadway. One such working machine is a milling machine or cold planer, a wheeled or track-driven vehicle that is provided with a rotating working drum that includes a plurality of cutting teeth. The drum is mounted in a housing on the frame of the machine and adapted to be lowered into contact with the road surface and rotated about a generally horizontal axis so as to cut into the surface to a desired depth as the machine is advanced along the roadway. Generally, a cold planer also includes a conveyor system that is designed to carry the milled material which has been cut from the roadway by the rotating drum to a location in front of, to the rear of, or beside the machine for deposit into a truck for removal from the milling site. One or more spray assemblies are typically mounted over the conveyors and inside the drum housing so that water may be sprayed to control the dust and heat that is generated in the milling process. If the machine is used for cold in-place recycling (as described hereinafter), a second spray assembly may be provided to spray asphalt cement onto the milled material on the roadway. Steerable track or wheel drive assemblies are provided to drive the machine and to steer it in a desired working direction. Power for driving the machine and for operating its systems is typically provided by a diesel engine.

Another type of working machine is a road stabilizer/reclaimer machine. This machine is similar to a cold planer in that it comprises a wheeled or track-driven vehicle that includes a milling assembly comprising a milling drum with a plurality of cutter teeth mounted thereon which is contained within a milling enclosure or chamber. However, the milling drum of a road stabilizer/reclaimer machine is generally employed to mill or pulverize an existing road bed or roadway to a greater depth than does a cold planer prior to repaving (usually called reclaiming) or prior to initial paving (usually called stabilizing), and it leaves the pulverized material in place. A water spray assembly, similar to that provided in a cold planer, is provided to control the dust and heat that is generated in the milling or pulverizing process. If the machine is used for cold in-place recycling (as described hereinafter), a second spray assembly may be provided to spray asphalt cement onto the pulverized material.

When a milling or stabilizing operation has been completed, paving of the roadway with asphalt paving material is generally carried out by an asphalt paving machine, another working machine. An asphalt paving machine is supplied with asphalt paving material by a number of supply trucks and/or a material transfer vehicle. The paving machine is self-propelled and driven by a wheeled or track drive system. In a common type of paving machine, an asphalt receiving hopper is located at the front end of the machine to receive asphalt paving material from a truck or material transfer vehicle, and a hopper conveyor located below the asphalt receiving hopper transfers the asphalt paving material from the hopper to a distributing assembly comprising a transverse distributing auger that is mounted near the rear of the machine. The asphalt paving material is deposited onto and across the roadway or other surface to be paved by the distributing auger, and a floating screed located at the rear end of the machine behind the distributing auger compacts the asphalt paving material to form an asphalt mat.

It is frequently desirable to apply asphalt cement or a similar substance (commonly referred to as "tack" or "tack material") onto the surface of the roadway prior to distributing and compacting the asphalt paving material into a mat to assist in binding the asphalt paving material to the underlying surface. Tack is typically sprayed onto the surface to be paved from a spray assembly that extends transversely across the surface to be paved. Some asphalt paving machines include a tack spray assembly that is adapted to deposit tack material onto the surface of the roadway ahead of the distributing auger. Sometimes the tack material is applied by another working machine, a tack distributor truck that travels ahead of the asphalt paving machine.

Cold in-place recycling ("CIR") equipment can be used to repair damage to a roadway in a single pass, while reusing essentially all of the existing asphalt paving material. In the CIR process, damaged layers of asphalt pavement are removed. The removed material is processed and replaced on the roadway and then compacted. If a roadway has good structural strength, a CIR process can be effective for treating all types of cracking, ruts and holes in asphalt pavement. CIR can be used to repair asphalt roadways damaged by fatigue (alligator) cracking, bleeding (of excess asphalt cement), block cracking, corrugation and shoving, joint reflective cracking, longitudinal cracking, patching, polished aggregate, potholes, raveling, rutting, slippage cracking, stripping and transverse (thermal) cracking. The root cause of the pavement failure should always be investigated to rule out base failure. However, CIR can almost always be used when there is no damage to the base of the roadway. Generally, CIR is only half as expensive as hot mix paving (i.e., paving with new asphalt paving material) while providing approximately 80% of the strength of hot mix paving.

CIR can be carried out with the aid of a milling machine or a road stabilizer/reclaimer machine that has been modified by mounting a spray assembly in the milling drum housing to inject asphalt cement into the milling drum housing. The asphalt cement is then thoroughly blended with the milled material by the milling drum and can be left in a windrow or fed by the milling machine's discharge conveyor directly into an asphalt paving machine. When the CIR process is carried out with only a milling machine or stabilizer/reclaimer and an asphalt paving machine, the asphalt cement component of the mixture must be supplied from a separate supply tank truck that is coupled to the modified milling machine or road stabilizer/reclaimer machine. The asphalt cement component is drawn directly from the tank on the supply truck and metered through a flow system that is mounted on the milling machine to the spray assembly in the milling drum housing.

Sometimes the CIR process is carried out with a milling machine or stabilizer/reclaimer in train with a cold recycler machine such as the RT-500 that is made and sold by Roadtec, Inc. of Chattanooga, Tenn. The cold recycler machine may include a vibratory screen, a crusher, an onboard source of asphalt cement and a pugmill mixer. When the CIR process is carried out using a cold recycler machine, the recycled asphalt material that is milled by the milling machine is transferred to the vibratory screen and then to the crusher on the cold recycler machine, and the screened and crushed material is then mixed with asphalt cement that is dispensed by a spray assembly from an onboard supply tank into the pugmill. In either configuration of equipment used in a CIR process, the primary component of the new pavement is asphalt paving material that is already in place on the roadway. The only other component of the new pavement is the asphalt cement carried by the cold recycler machine or by a supply truck. Since the rate of advance of the equipment engaged in the CIR process is determined primarily by the rate of advance of the milling machine, it is common for all of the components of the CIR process except for the asphalt paving machine to be coupled together so as to move at the same rate during all phases of the CIR process. Such components are frequently referred to as a CIR train.

The various spray assemblies that are found on milling machines, stabilizer/reclaimer machines, asphalt paving machines, cold recycler machines and tack distributor trucks are sized to extend across the width of the working machine. Milling machines sold in the United States generally are produced in various sizes that cut a width within the range of 4-13 feet. Stabilizer/reclaimer machines sold in the United States are generally produced in various sizes that cut a width within the range of 6.5-8.5 feet. Asphalt paving machines sold in the United States are generally produced in various sizes that pave a width within the range of 8-15 feet. In addition, some milling machines and stabilizer/reclaimer machines can accommodate milling drums of different widths, and asphalt paving machines typically can be provided with distributing augers of different widths and screed extensions that increase the width of the asphalt mat they can provide.

Typical spray assemblies are configured in a single size to fit across the width of a specific working machine. Consequently, if a milling drum on a working machine is replaced with a drum of a different size, or if a screed extension is added to a working machine, the spray assembly on the working machine must be replaced. Asphalt paving machines with tack spray assemblies and movable (i.e., extendible) screed extensions may include separate tack spray assemblies that are attached to the screed extensions. It would be desirable if a spray assembly could be provided in modular form so that it could easily be configured to accommodate any desired width of a working machine. It would also be desirable if a modular spray assembly could be provided that would allow the addition and removal of modular components without removing the base portion of the spray assembly from the working machine.

Advantages of Preferred Embodiments of the Invention

Among the advantages of this invention is that it provides a modular spray assembly for a working machine that is easily configured to accommodate any desired width of a working machine. Another advantage of the invention is that it provides a modular spray assembly that allows the addition and removal of modular components without removing the base portion of the spray assembly from the working machine. Additional objects and advantages of this invention will become apparent from an examination of the drawings and the ensuing description.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "attached", "connected" and "interconnected", refer to a relationship wherein structures or components are secured or attached to one another either directly or indirectly through intervening structures, as well as both moveable and rigid attachments or relationships, unless specified herein or clearly indicated by context. The terms "operatively attached" and "operatively connected" describe such an attachment, coupling or connection that allows the pertinent structures or components to operate as intended by virtue of that relationship. The term "fluid communication" is such an attachment, coupling or connection that allows for flow of fluid from one such structure or component to or by means of the other.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

The term "aggregate material(s)" and similar terms refer to crushed stone and other particulate materials that are used in the production of asphalt paving materials, such as, for example, crushed limestone and other types of crushed stone, crushed Portland cement concrete, shredded or comminuted mineral and cellulosic fibers, recycled asphalt pavement that is removed from a roadway by a milling machine or in a CIR process (as hereinafter defined), recycled asphalt shingles, gravel, sand, lime and other particulate additives.

The term "asphalt cement" and similar terms refer to a bituminous fluid that is used in combination with aggregate materials in the production of asphalt paving materials, or as a tack material. The term "asphalt cement" includes asphalt emulsions which are chemically stabilized dispersions of asphalt cement in water.

The term "working fluid" refers to a fluid such as asphalt cement or water that is dispensed by a spray assembly of a working machine.

The term "thermal fluid" refers to a fluid that is circulated within or through a spray assembly of a working machine for heat transfer purposes, but is not dispensed by the spray assembly.

The term "asphalt paving material(s)" and similar terms refer to a bituminous paving mixture that is produced, using asphalt cement and any of various aggregate materials.

The terms "asphalt paving machine" and "paver" refer to a working machine for applying asphalt paving material to form an asphalt mat on a roadway, parking lot or similar surface. An asphalt paving machine or paver is typically a self-propelled vehicle having a hopper at one end for receiving asphalt paving material and a floating screed at the other end for forming an asphalt mat.

The term "milling machine" refers to a working machine having a milling or working drum that is adapted to be placed into contact with a roadway or road base surface for removing a portion of the surface. The term "milling machine" includes but is not limited to machines that are sometimes referred to as cold planers, road stabilizers and roadway reclaiming machines. The term "milling machine" also includes a CIR-modified milling machine, as hereinafter defined.

The term "CIR process" refers to a use of cold in-place recycling equipment to repair damage to a roadway, by removing layers of asphalt pavement, processing the asphalt paving material so removed, replacing the removed and processed asphalt paving material onto the roadway, and compacting it.

The term "CIR-modified milling machine" refers to a milling machine which has been modified by the addition of an asphalt cement flow system including a spray assembly that is adapted to dispense asphalt cement into the milled material within or adjacent to the milling drum housing.

The term "working machine" refers to a road working machine that includes a spray assembly for use in dispensing a working fluid onto a roadway, onto aggregate materials in a CIR process, and/or onto or within components of a working machine for heat dissipation and/or dust control.

The terms "above", "upper" and similar terms, when used with respect to a spray assembly of a working machine or a component of such a spray assembly, refer to a relative location or direction away from the surface on which the machine is operated.

The terms "below", "lower" and similar terms, when used with respect to a spray assembly of a working machine or a component of such a spray assembly, refer to a relative location or direction towards the surface on which the machine is being operated.

The term "working direction" refers to the primary direction of travel of a working machine as it operates in working on a roadway or other surface.

The term "width", when used to refer to a dimension of a working machine, refers to a dimension that is measured across the roadway being worked and is substantially perpendicular to the working direction.

The term "frame" means the structural part of a working machine that supports a spray assembly.

The term "linear actuator" refers to an electric, pneumatic, hydraulic, electro-hydraulic or mechanical device that generates force which is directed in a straight line.

SUMMARY OF THE INVENTION

The invention comprises a modular spray assembly that is mounted to the frame of a working machine. The working machine includes a storage tank for a working fluid and is adapted for operation on a roadway. The modular spray assembly includes a base assembly that is attached to the frame of the working machine. The base assembly comprises a working fluid conduit having an open end and a closed end. A plurality of nozzle assemblies are attached to and are in fluid communication with the working fluid conduit. A modular component comprises a modular fluid conduit. This modular fluid conduit has a first end and a second end that is adapted to be removably attached to the open end of the working fluid conduit so as to be in fluid communication with the working fluid conduit. A nozzle assembly is located between the first end of the modular component and the second end of the modular component. This nozzle assembly is attached to and in fluid communication with the modular fluid conduit. An open end component is adapted to be removably and alternatively attached to the open end of the working fluid conduit or to the first end of the modular component. This open end component includes a working fluid supply pipe that is in fluid communication with the working fluid storage tank.

A preferred embodiment of the invention includes a thermal fluid storage tank and a thermal fluid circulating system by which thermal fluid is circulated from the thermal fluid storage tank through the modular spray assembly for heat transfer purposes and back to the thermal fluid storage tank. In this embodiment of the invention, the open end component includes a thermal fluid output connector and a thermal fluid input connector. The base assembly includes a thermal fluid supply line and a thermal fluid return line in the base assembly, and a thermal fluid connector that connects the thermal fluid supply line to the thermal fluid return line in the closed end of the working fluid conduit. This embodiment of the invention also includes a thermal fluid input line that is in fluid communication with the thermal fluid storage tank and the thermal fluid input connector of the end component, and a thermal fluid output line that is in fluid communication with the thermal fluid storage tank and the thermal fluid output connector of the end component. In this embodiment of the invention, the modular component includes a thermal fluid supply line extension that is adapted to be connected between the thermal fluid supply line in the base assembly and the thermal fluid input connector of the end component, and a thermal fluid return line extension that is adapted to be connected between the thermal fluid return line in the base assembly and the thermal fluid output connector of the end component.

In order to facilitate an understanding of the invention, a preferred embodiment of the invention, as well as the best mode known by the inventor for carrying out the invention, is illustrated in the drawings, and a detailed description thereof follows. It is not intended, however, that the invention be limited to the particular embodiment described or to use in connection with the apparatus illustrated herein. Therefore, the scope of the invention contemplated by the inventor includes all equivalents of the subject matter recited in the claims, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiment of the invention is illustrated in the accompanying drawings, in which like reference numerals represent like parts throughout, and in which.

DESCRIPTION OF THE PREFERRED EMBODIMENT OF THE INVENTION

This description of the preferred embodiment of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness. In the various drawings, the same reference numbers are used to indicate the same components, and arrows marked with "WF" indicate the direction of flow of a working fluid such as asphalt cement.

Figure 1:
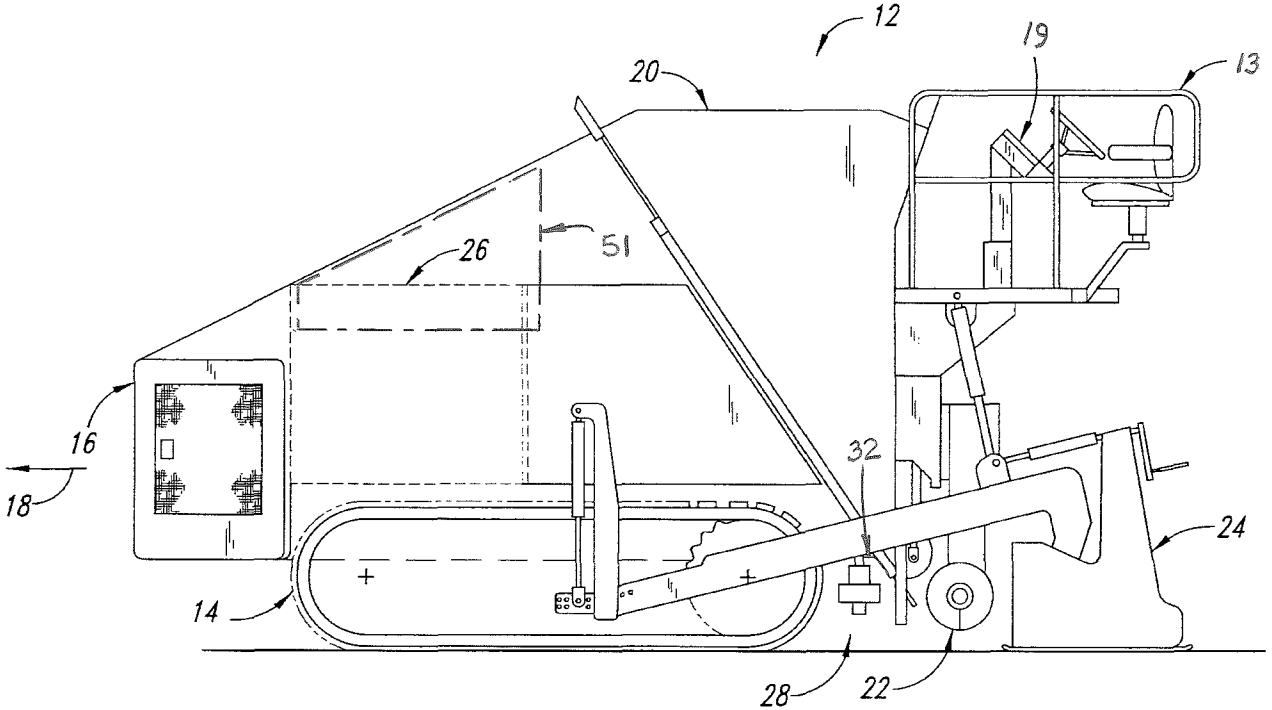
FIG. 1 is a side view of an asphalt paving machine which includes the invention.

The invention comprises a modular spray assembly for use in connection with a working machine such as asphalt paving machine 12 shown in FIG. 1. Paving machine 12 includes operator's station 13 and track drive system 14 that is driven by an engine (not shown, but housed in engine compartment 16) so as to move in the working (or paving) direction indicated by arrow 18. Controller 19 is located in the operating station and is adapted to control the modular spray assembly and other operating components of the paving machine. Paving machine 12 also includes gravity-fed hopper 20 that is adapted to receive a quantity of asphalt paving material from a delivery truck or material transfer vehicle (not shown). A conventional conveyor (also not shown) is mounted in the bottom of hopper 20 and adapted to convey asphalt paving material from hopper 20 to transverse distributing auger 22 which operates to distribute the asphalt paving material across the width of the roadway or portion thereof to be paved. Floating screed 24 is located behind the distributing auger and adapted to level and compact the asphalt paving material to form an asphalt mat. Asphalt paving machine 12 also includes working fluid storage tank 26 for asphalt cement to be used as tack material, which working fluid storage tank is in fluid communication with modular spray assembly 28. As would be appreciated by those having ordinary skill in the art to which the invention relates, this fluid communication comprises a fluid circuit between working fluid storage tank 26 and modular spray assembly 28 which includes a pump and suitable piping or hoses to convey the tack material from the storage tank to the modular spray assembly.

Figure 2:
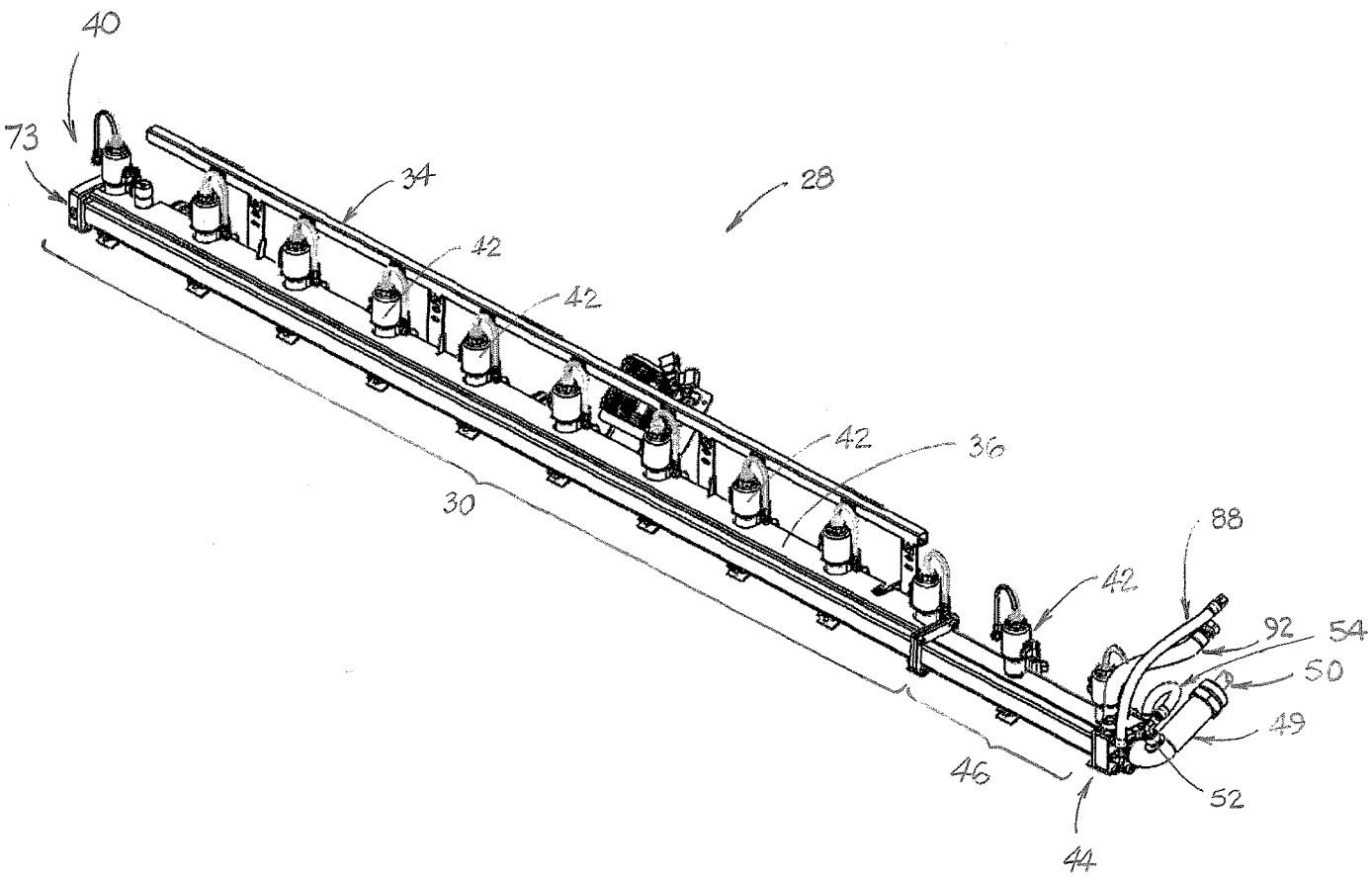
FIG. 2 is a perspective view of a first embodiment of the modular spray assembly of the invention.
Figure 3:
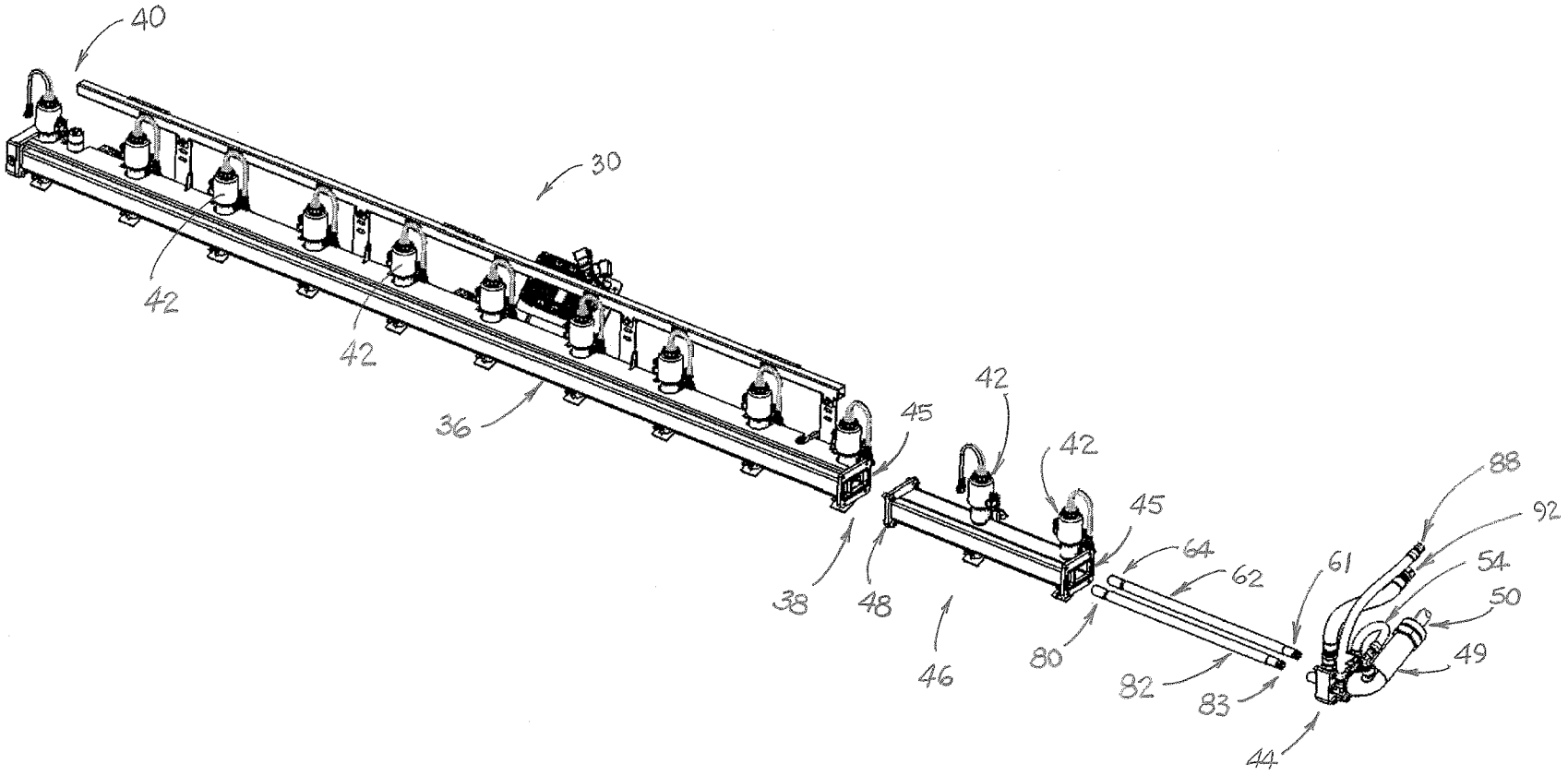
FIG. 3 is an exploded perspective view of a first portion of the first embodiment of the modular spray assembly shown in FIG. 2.
Figure 4:
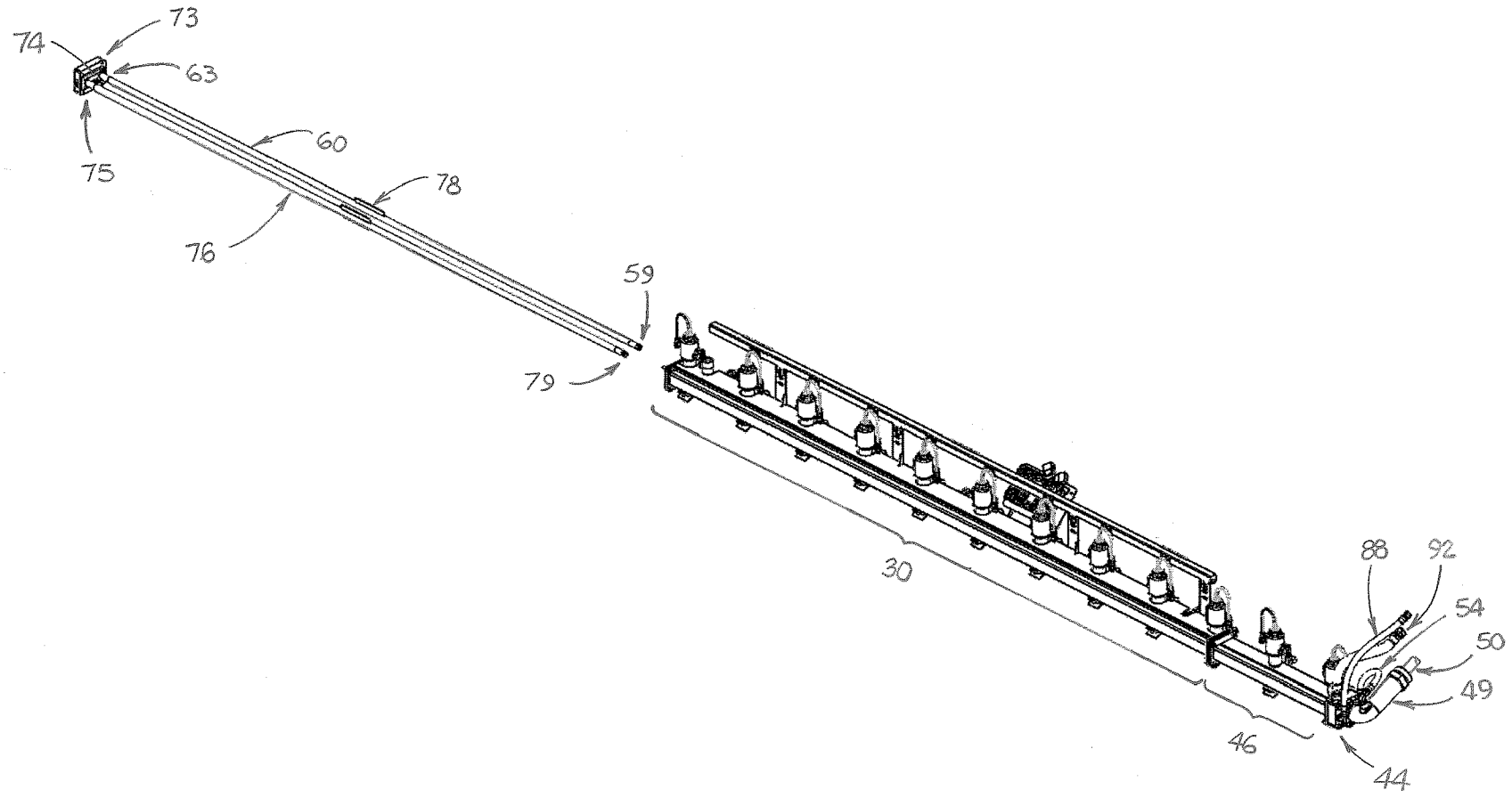
FIG. 4 is an exploded perspective view of a second portion of the first embodiment of the modular spray assembly shown in FIGS. 2 and 3.
Figure 5:
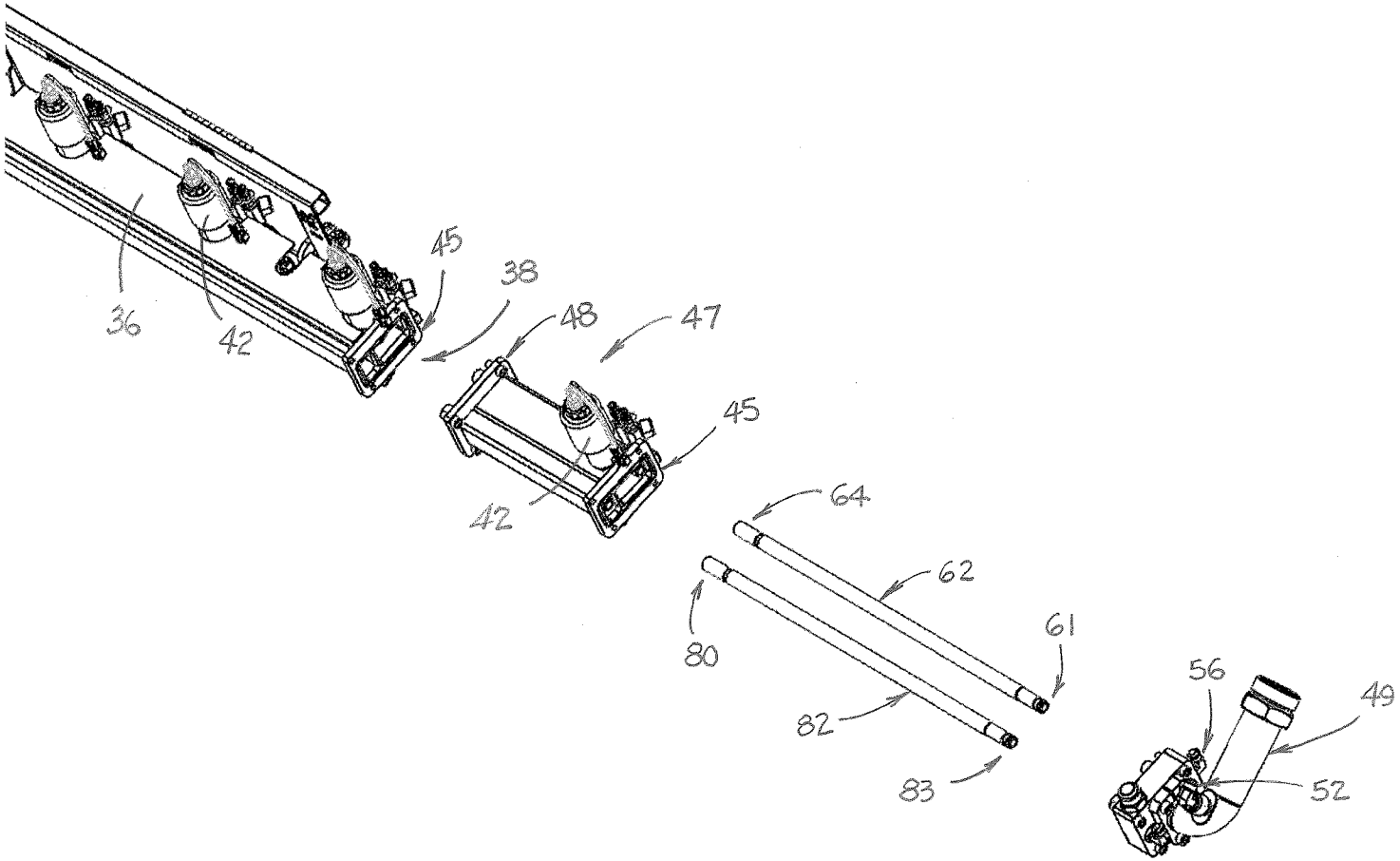
FIG. 5 is an exploded perspective view of a portion of a second embodiment of the modular spray assembly of the invention.
Figure 6:
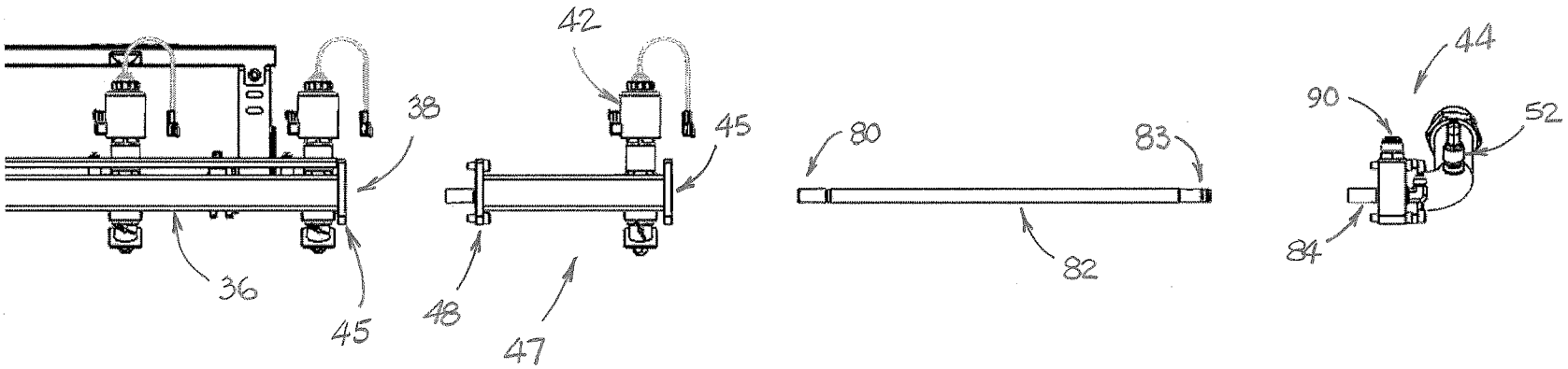
FIG. 6 is a front view of the portion of the second embodiment of the modular spray assembly that is illustrated in FIG. 5.

As shown in FIGS. 2-4, modular spray assembly 28 includes base assembly 30 that is attached to frame 32 of asphalt paving machine 12, by means of support beam 34. Base assembly 30 comprises working fluid conduit 36 and has open end 38 and closed end 40. A plurality of nozzle assemblies 42 are attached to and in fluid communication with the working fluid conduit. Open end component 44 is adapted to be removably attached to bracket 45 on open end 38 of working fluid conduit 36 by means of bolts or other suitable fasteners known to those having ordinary skill in the art to which the invention relates, or to bracket 45 on the first end of modular component 46 (shown in FIGS. 2-4), or to bracket 45 on the first end of modular component 47 (shown in FIGS. 5 and 6), or to a bracket (not shown) on the first end of a modular component having more than two nozzle assemblies 42 (also not shown). Both modular component 46 and modular component 47 have a bracket 48 on the second end which mates with bracket 45 on open end 38 of working fluid conduit 36 or with bracket 45 on the first end of another modular component. Open end component 44 includes asphalt cement supply pipe 49 that is in fluid communication with asphalt cement storage tank 26. Modular component 46 comprises a modular fluid conduit that is adapted to be removably and alternatively attached to the open end of working fluid conduit 36 so as to be in fluid communication therewith, or to the first end of another modular component. Modular component 46 includes a pair of nozzle assemblies 42 that are attached to and in fluid communication with the modular component. Modular component 47 comprises a modular fluid conduit that includes a single nozzle assembly 42, but other modular components may be provided of various lengths and including any convenient number of nozzle assemblies.

Figure 7:
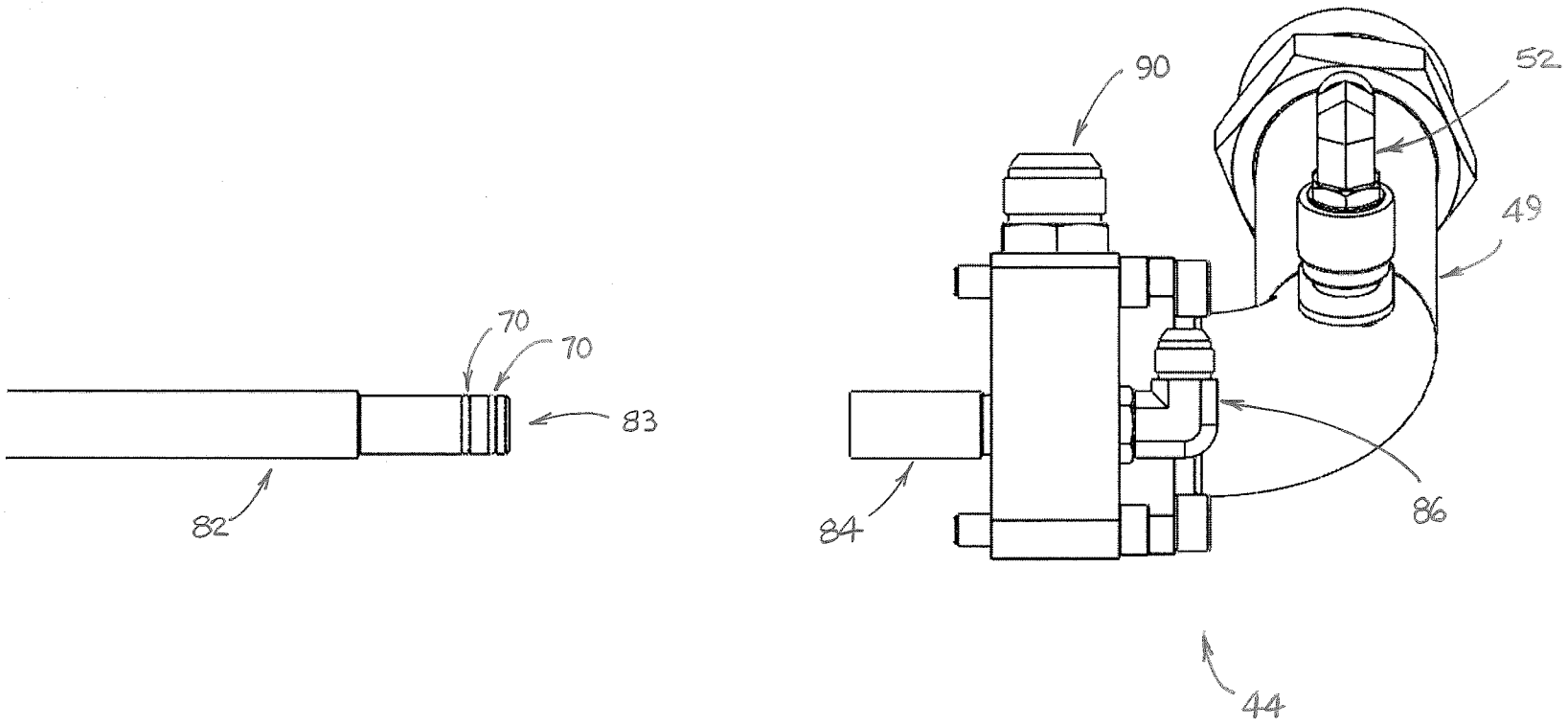
FIG. 7 is an enlarged front view of the open end component of the invention and an associated modular assembly return line.
Figure 8:
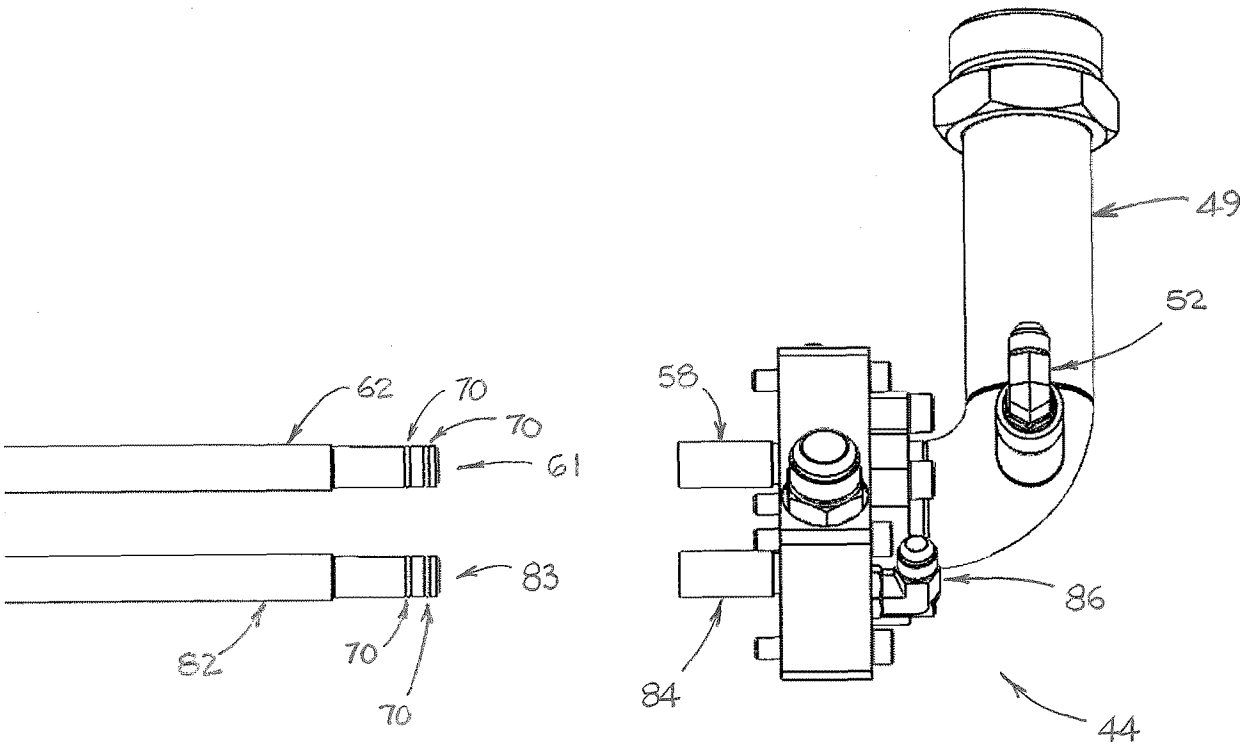
FIG. 8 is a bottom view of the components of the invention illustrated in FIG. 7, also showing an associated modular assembly supply line.
Figure 9:
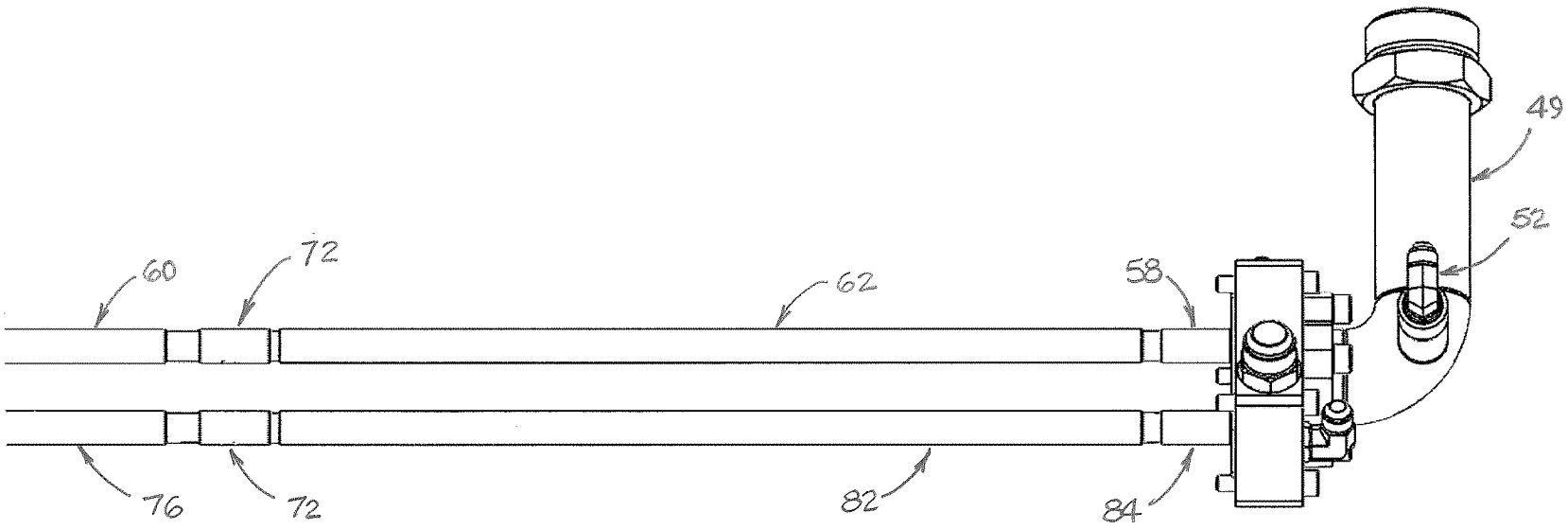
FIG. 9 is a bottom view of the components of the invention illustrated in FIGS. 7 and 8, showing these components assembled together.

The preferred embodiment of the invention shown in the drawings includes a thermal fluid circulating system by which thermal fluid is circulated through the modular spray assembly, in thermal communication with the working fluid, for heat transfer purposes. In this embodiment of the invention, open end component 44 also includes thermal fluid input line 50 that passes through asphalt cement supply pipe 49 so as to be in thermal communication therewith. Asphalt paving machine 12 also includes thermal fluid storage tank 51 for a thermal fluid such as oil, which thermal fluid storage tank is in fluid communication with thermal fluid input line 50 of modular spray assembly 28. As shown in FIG. 1, thermal fluid storage tank 51 is located laterally outside of and above asphalt cement storage tank 26. As would be appreciated by those having ordinary skill in the art to which the invention relates, the fluid communication between thermal fluid storage tank 51 and thermal fluid input line 50 of modular spray assembly 28 comprises a fluid circuit which includes a pump and suitable piping or hoses to circulate the thermal fluid between the thermal fluid storage tank and the modular spray assembly. In the preferred embodiment of the invention shown in the drawings, thermal fluid passing through thermal fluid input line 50 passes out of asphalt cement supply pipe 49 at connector 52, passes through intermediate thermal fluid line 54, re-enters open end component 44 at connector 56 (best shown in FIG. 5) and terminates (with respect to the open end component) in thermal fluid input connector 58, as shown in FIGS. 8 and 9. Thermal fluid input connector 58 is adapted to be connected in fluid communication with first end 59 of thermal fluid supply line 60 in base assembly 30 or alternatively, with first end 61 of thermal fluid supply line extension 62 in modular component 46 (shown in FIGS. 2-4) or in modular component 47 (shown in FIGS. 5 and 6). Preferably, thermal fluid input connector 58 comprises a female connection into which first end 59 of thermal fluid supply line 60 or first end 61 of thermal fluid supply line extension 62 may be inserted. In this embodiment of the invention, both first end 59 and second end 63 of thermal fluid supply line 60 are essentially identical, as are first end 61 and second end 64 of thermal fluid supply line extension 62. First end 59 of thermal fluid supply line 60 and first end 61 of thermal fluid supply line extension 62 are preferably provided with a pair of O-rings 70 (best shown in FIGS. 7 and 8) to insure a fluid-tight fit with thermal fluid input connector 58. When modular component 46 is attached to base assembly 30, thermal fluid connector sleeve 72 is employed to provide for a fluid-tight fit between an end of thermal fluid supply line extension 62 and the adjacent first end 59 of thermal fluid supply line 60. Closed end component 73 is fixed to closed end 40 of working fluid conduit 36 and includes thermal fluid connector 74 (shown in FIG. 4) that connects second end 63 of thermal fluid supply line 60 to second end 75 of thermal fluid return line 76. Thermal fluid return line 76 is essentially identical to thermal fluid supply line 60. Support 78 may be provided in base assembly 30 to support thermal fluid supply line 60 and thermal fluid return line 76 within working fluid conduit 36.

When a modular component such as modular component 46 is attached to base assembly 30, first end 79 of thermal fluid return line 76 is attached by means of thermal fluid connector sleeve 72 to second end 80 of thermal fluid return line extension 82 in modular component 46 or to second end 80 of thermal fluid return line extension 82 in modular component 47. Thermal fluid return line extension 82 is essentially identical to thermal fluid supply line extension 62. First end 83 of thermal fluid return line extension 82 is preferably provided with a pair of O-rings 70 (best shown in FIG. 8) to insure a fluid-tight fit with thermal fluid output connector 84 of open end component 44. Thermal fluid that flows through thermal fluid return line 76 and thermal fluid return line extension 82 into thermal fluid output connector 84 of open end component 44 flows out of the open end component through connector 86 and thermal fluid output line 88 and is circulated back to thermal fluid storage tank 51.

Figure 10:
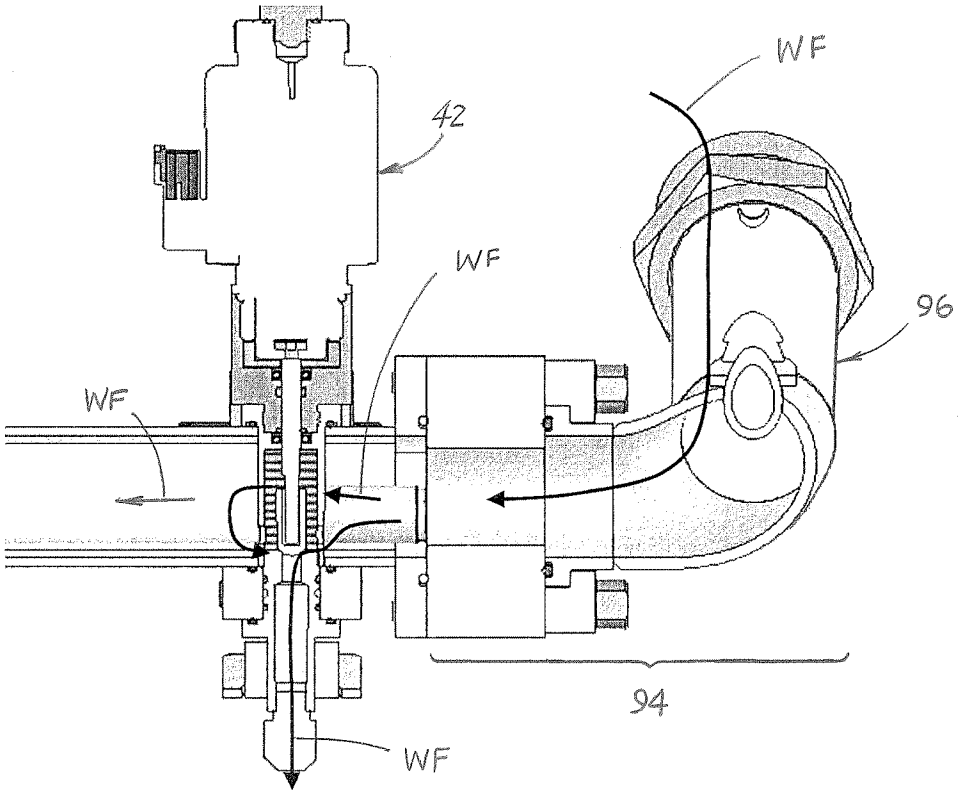
FIG. 10 is a sectional view of a portion of an embodiment of the invention showing a portion of the working fluid flow path.

In the embodiment of the invention illustrated in FIGS. 2-9, open end component 44 comprises a recirculating component for both thermal fluid and working fluid. Thus, working fluid enters open end component 44 through asphalt cement supply pipe 49, passes through working fluid conduit 36, and, optionally, one or more modular components, through various nozzle assemblies 42 and back out of connector 90 through working fluid return line 92 and is circulated back to asphalt cement storage tank 26. In the embodiment shown in FIG. 10, however, there is no recirculation of the working fluid. Thus, in the non-circulating embodiment, working fluid enters open end component 94 through asphalt cement supply pipe 96, passes through working fluid conduit 36, and, optionally, one or more modular components, and through various nozzle assemblies 42 onto the roadway.

The invention provides a modular spray assembly for a working machine that is easily configured to accommodate any desired width of a working machine by adding modular components of various convenient sizes. This modular spray assembly also allows the addition and removal of modular components without removing the base portion of the spray assembly from the working machine.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A modular spray assembly for a working machine that includes a frame and a working fluid storage tank and is adapted for operation on a roadway, said modular spray assembly further comprising:

(a) a base assembly that is attached to the frame of the working machine, said base assembly comprising:
  (i) a working fluid conduit having an open end and a closed end;
  (ii) a plurality of nozzle assemblies that are attached to and are in fluid communication with the working fluid conduit;

(b) a modular component comprising a modular fluid conduit which further comprises:
  (i) a first end;
  (ii) a second end that is adapted to be removably attached to the open end of the working fluid conduit so as to be in fluid communication with the working fluid conduit; and
  (iii) a nozzle assembly between the first end and the second end which is attached to and in fluid communication with the modular fluid conduit;

(c) an open end component that is adapted to be removably and alternatively attached to the open end of the working fluid conduit or to the first end of the modular component, said open end component including a working fluid supply pipe that is in fluid communication with the working fluid storage tank.

2. The modular spray assembly of claim 1 wherein the open end component comprises a recirculating component for working fluid.

3. The modular spray assembly of claim 2:

(a) which includes a working fluid return line that is in fluid communication with the working fluid storage tank;

(b) wherein the open end component further comprises a connector for the working fluid return line.

4. The modular spray assembly of claim 1 which includes a thermal fluid storage tank and a thermal fluid circulating system by which thermal fluid is circulated from the thermal fluid storage tank through the modular spray assembly for heat transfer purposes and back to the thermal fluid storage tank.

5. The modular spray assembly of claim 4, wherein the open end component comprises a recirculating component for thermal fluid.

6. The modular spray assembly of claim 4:

(a) wherein the open end component includes a thermal fluid output connector and a thermal fluid input connector;

(b) which includes a thermal fluid supply line in the base assembly, said thermal fluid supply line having a first end and a second end;

(c) which includes a thermal fluid return line in the base assembly, said thermal fluid return line having a first end and a second end;

(d) which includes a thermal fluid connector that connects the second end of the thermal fluid supply line to the second end of the thermal fluid return line in the closed end of the working fluid conduit;

(e) which includes a thermal fluid input line that is in fluid communication with the thermal fluid storage tank and the thermal fluid input connector of the end component;

(f) which includes a thermal fluid output line that is in fluid communication with the thermal fluid storage tank and the thermal fluid output connector of the end component;

(g) which includes a thermal fluid supply line extension in the modular component that is adapted to be connected between the first end of the thermal fluid supply line in the base assembly and the thermal fluid input connector of the end component;

(h) which includes a thermal fluid return line extension in the modular component that is adapted to be connected between the first end of the thermal fluid return line in the base assembly and the thermal fluid output connector of the end component.

7. The modular spray assembly of claim 6 wherein the thermal fluid input line passes through the working fluid supply pipe so as to be in thermal communication therewith.

8. The modular spray assembly of claim 6 wherein:

(a) the thermal fluid output connector comprises a female connection into which an end of the thermal fluid return line or an end of the thermal fluid return line extension may be inserted;

(b) the thermal fluid input connector comprises a female connection into which an end of the thermal fluid supply line or an end of the thermal fluid supply line extension may be inserted.

* * * * *